US008561681B2

(12) United States Patent
Antonijevic

(10) Patent No.: US 8,561,681 B2
(45) Date of Patent: Oct. 22, 2013

(54) MULTIPLE FLOW HEAT EXCHANGER

(75) Inventor: Dragi Antonijevic, Belgrade (RS)

(73) Assignee: Visteon Global Technologies, Inc., Van Buren Township, MI (US)

( * ) Notice: Subject to any disclaimer, the term of this patent is extended or adjusted under 35 U.S.C. 154(b) by 1029 days.

(21) Appl. No.: 11/997,781

(22) PCT Filed: Aug. 4, 2006

(86) PCT No.: PCT/DE2006/001399

§ 371 (c)(1),
(2), (4) Date: Feb. 4, 2008

(87) PCT Pub. No.: WO2007/014560

PCT Pub. Date: Feb. 8, 2007

(65) Prior Publication Data

US 2008/0308264 A1 Dec. 18, 2008

(30) Foreign Application Priority Data

Aug. 4, 2005 (DE) ..... 10 2005 037 984
Apr. 6, 2006 (DE) ..... 10 2006 017 434

(51) Int. Cl.
*F28F 9/02* (2006.01)
*F28F 13/00* (2006.01)

(52) U.S. Cl.
USPC ..... 165/175; 165/135

(58) Field of Classification Search
CPC .... F28F 9/0024; F28F 9/0212; F28D 1/05391
USPC ..... 165/173, 174, 175, 176, 153
See application file for complete search history.

(56) References Cited

U.S. PATENT DOCUMENTS

| | | | | |
|---|---|---|---|---|
| 4,972,683 | A * | 11/1990 | Beatenbough | 62/507 |
| 5,868,198 | A * | 2/1999 | Kato | 165/153 |
| 6,793,012 | B2 * | 9/2004 | Fang et al. | 165/140 |
| 2003/0155109 | A1 | 8/2003 | Kawakubo et al. | |
| 2003/0213587 | A1 * | 11/2003 | Mano et al. | 165/174 |
| 2004/0261983 | A1 * | 12/2004 | Hu | 165/148 |
| 2005/0006068 | A1 * | 1/2005 | Desai et al. | 165/140 |
| 2005/0061489 | A1 * | 3/2005 | Yu et al. | 165/140 |
| 2005/0133207 | A1 | 6/2005 | Scoville et al. | |
| 2006/0021746 | A1 * | 2/2006 | Lorentz et al. | 165/174 |
| 2007/0044953 | A1 * | 3/2007 | Hu | 165/287 |

FOREIGN PATENT DOCUMENTS

| | | | |
|---|---|---|---|
| DE | 197 29 239 | A1 | 1/1999 |
| DE | 103 46 032 | A1 | 4/2004 |
| DE | 195 36 116 | B4 | 8/2005 |
| EP | 0 859 209 | A1 | 8/1998 |

(Continued)

*Primary Examiner* — Tho V Duong
(74) *Attorney, Agent, or Firm* — Fraser Clemens Martin & Miller LLC; J. Douglas Miller

(57) ABSTRACT

The invention relates to a multiple flow heat exchanger (1), especially a gas cooler, comprising at least two flows (2, 3) passable by a fluid (13) in opposite directions and which respectively comprise a group of parallel channels (4) provided with lamellae (5) positioned between the channels (4) in a sandwich-type manner. A deflecting pocket (6) is positioned on a first front side (1.1) of the heat exchanger (1), for reversing the direction of the fluid (13), and a fluid distributor (7) for a first flow (2) and a fluid collector (8) for a second flow (3) are arranged on a second opposing front side (1.2) of the heat exchanger (1). According to the invention, the adjacent channels (4.1), each with a different fluid temperature, for the adjacent flows (2, 3), are thermally decoupled from each other.

15 Claims, 5 Drawing Sheets

(56) References Cited

FOREIGN PATENT DOCUMENTS

Figure 1:
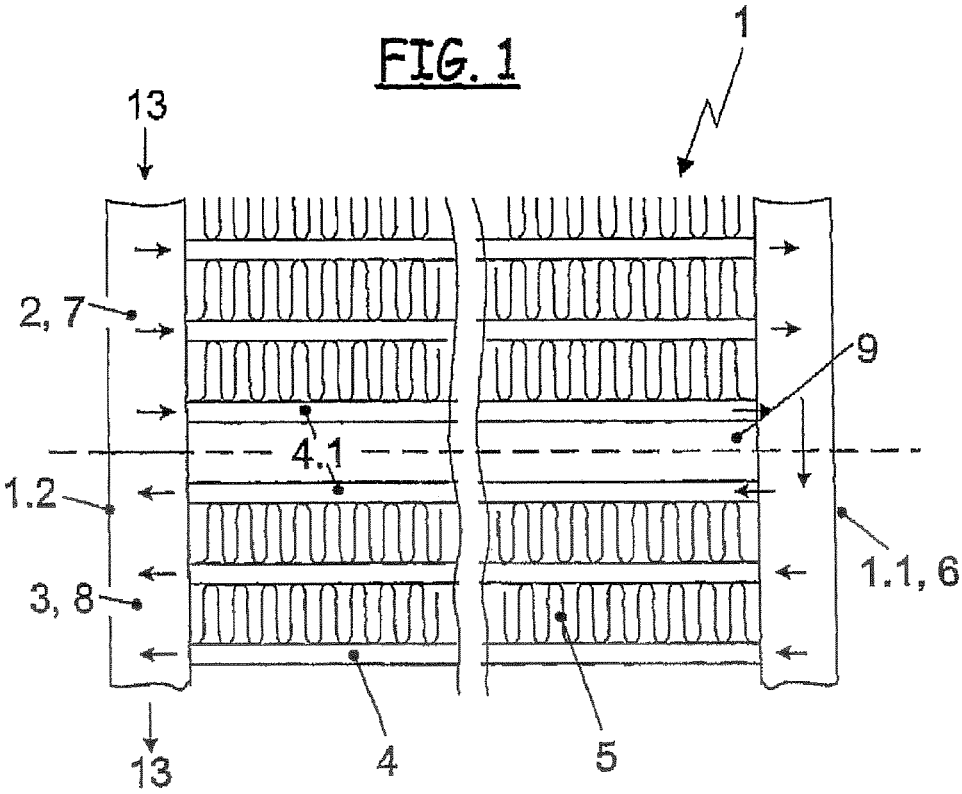

| | | | | |
|---|---|---|---|---|
| EP | 1 003 005 | A1 | | 11/1999 |
| EP | 1 003 005 | A1 | | 5/2000 |
| EP | 1 477 760 | A2 | | 11/2004 |
| JP | 02064396 | A | | 5/1990 |
| JP | 03211377 | A | | 7/1991 |
| JP | 03211377 | A | | 9/1991 |
| JP | 2005083725 | A | * | 3/2005 |

* cited by examiner

MULTIPLE FLOW HEAT EXCHANGER

Generally, the invention relates to a multiple-flow heat exchanger according to the generic term of claim 1 comprising at least two flows through which a fluid can pass in opposite directions and which each comprise a group of parallel channels provided with lamellae positioned between the channels in a sandwich-type manner. Especially, the invention relates to a heat exchanger established as gas cooler for use in vehicle HVACs operated based on $CO_2$ as the refrigerant fluid.

An HVAC cycle based on $CO_2$-refrigerant fluid is predominantly transcritical. In the gas cooler, there is a great difference in the temperature of the $CO_2$-refrigerant fluid, especially in the area of the fluid collector and the fluid distributor of the gas cooler. In the case of generic gas coolers, which in addition to the channels carrying refrigerant fluid are provided with lamellae positioned between the channels and brazed to the channels, it may happen for a certain combination of limiting conditions that the lamellae conduct a considerable heat flow from a warmer to a colder channel. This heat flow is a heat loss, because it re-heats the refrigerant flow already cooled. Thus heat undesirably remains in the refrigerant fluid instead of being dissipated to the ambient air.

Approximately equal temperatures develop at both lamella bends of the lamellae brazed between the refrigerant channels; the temperature minimum—e.g. in case of condenser, gas cooler, and radiator—is the center of the lamella, the heat flowing toward the center of the lamella while being dissipated by convection to the air flow at the same time. For heat exchangers heated by air such as evaporators, the situation of the temperature in the center of the lamella is opposite, namely a temperature maximum, but the principles remain same.

From DE 103 46 032 A1 a heat exchanger is known in that between a channel on the entry side, the channel formed in a part of the heat exchanger tubes, and a channel on the exit side, the channel formed in the other part of the heat exchanger tubes, at least one at exchange preventing device is provided for preventing the heat from moving between a first fluid flowing in the channel on the entry side and a first fluid flowing in the channel on the delivery side. The heat exchange preventing device is formed here by a constricted portion with a small cross-sectional area between the channel on the entry side and the channel on the delivery side of the heat exchanger tubes. Also, the heat exchange preventing device can be established as a slot in the lamellae, possibly provided with heat insulation.

In DE 195 36 116 B4, a heat exchanger for a motor vehicle is described that comprises a unit including two collector tubas and a lamellae tube block installed between said collector tubes for a first circuit for conducting a heat exchanger medium, the unit being equipped with heat exchanger means for at least one further circuit for conducting another heat exchanger medium. The unit including collector tubes and the lamellae tube block is divided into at last two mutually independent heat exchanging zones, whereby the heat exchanger means for the at least one further circuit are integrated into at least one heat exchanging zone. This invention is characterized by that in each of both collector tubes a separation wall arrangement is formed at equal level by two terminating walls with a space in between and the space limited by the two terminating walls is provided with a control hole leading outward.

Disadvantageous of the inventions mentioned above is the not unimportant manufacture effort necessary to avoid undesirable heat transmission between the channels with different fluid temperatures.

The object of the invention is now to propose a multiple-flow heat exchanger, especially gas cooler, where in a simple constructional manner, heat transmission, leading to undesirable heat losses, between the channels having different fluid temperatures with lamellae positioned between the channels in a sandwich-like manner is avoided or largely reduced.

The problem is solved by a multiple-flow heat exchanger, especially gas cooler, comprising at least two flows through which a fluid can pass in opposite directions and which each comprise a group of parallel channels provided with lamellae positioned between the channels in a sandwich-type manner. A deflecting pocket is positioned on a first front side of the heat exchanger, for reversing the direction of the fluid, and a fluid distributor for a first flow and a fluid collector for a second flow are arranged an a second opposing front side of the heat exchanger. According to the invention, the adjacent channels, each with a different fluid temperature, for the adjacent flows, are thermally decoupled from each other.

The following is begun by mentioning that the thermal decoupling, according to the invention, of the adjacent channels, each with a different fluid temperature, of the adjacent flows can be used for reducing heat losses independently of the design and use of a heat exchanger established as a lamella-channel block. The heat exchanger may be designed in one row design or multiple row design. In a multiple-row design, at least two rows, each formed of channels with lamellae positioned between the channels, are provided, the rows being connected together in parallel planes by use of tubes to form a common lamella-channel block.

Apart from a gas cooler, also condensers, radiators or evaporators can be provided as heat exchanger. For the use as gas cooler, the environmentally neutral $CO_2$ is used as refrigerant fluid.

Even if solely the term lamella is used in the following description, a fin is meant to be included.

The thermal decoupling avoids or at least reduces undesirable heat transmission that would contribute to reduced efficiency of the heat exchanger between the adjacent channels, each with a different fluid temperature, for the adjacent flows and into the environment as well. This effect is the more important, the larger the temperature drop of the fluid in direction of flow through the channels of the heat exchanger is. The focus of thermal decoupling is in the area of the fluid collector and the fluid distributor, as it is naturally at these places that there is the greatest difference in temperature between the fluid entering the channels at a high temperature and the fluid exiting from the channels at a lower temperature.

The thermal decoupling can be realized by different design measures.

In a first preferred embodiment of the invention, a thermal insulator instead of the lamella is provided between the adjacent channels, each with a different fluid temperature, for the adjacent flows. A poor heat conductor with high thermal resistance such as a non-metal is a suitable material for a thermal insulator. Preferably, the thermal insulator totally fills the room between the adjacent channels, each with a different fluid temperature.

In a second preferred embodiment of the invention, the structural space between the adjacent channels, each with a different fluid temperature, for the adjacent flows is established free from lamellae for thermal decoupling. This structural space, or distance, respectively, between these fluid-carrying channels can have an amount advantageously larger than the amount of the remaining distances of the channels of a flow.

In a third preferred embodiment of the invention, for thermal decoupling of the adjacent channels, each with a different fluid temperature, for the adjacent flows, the lamella positioned in between is in its longitudinal extension at least partially provided with a slot. Due to the slot two lamella halves separated to each other by an air gap and opposing each other form that are connected to the respective adjacent channels typically by brazing. The air gap developing can have a variable width dependent on the heat power to be transferred of the heat exchanger or on the temperature drop of the fluid.

In a fourth preferred embodiment of the invention, for thermal decoupling of the adjacent channels, each with a different fluid temperature, for the adjacent flows, the lamella positioned in between has in its longitudinal extension a structural height and/or material thickness different from that of the remaining lamellae. Enlarged lamella height, first, raises the heat transmission distance between the differently tempered channels, and second, reduces the heat transfer coefficient, because the flow velocity of the air flowing in direction normal to the lamella is reduced. The material thickness of this lamella is dimensioned allowing for the difference of the air-side pressure drop due to the lamella.

In a fifth preferred embodiment of the invention, for thermal decoupling of the adjacent channels, each with a different fluid temperature, for the adjacent flows, a thermal insulator protection layer is provided applied to either only one or both of said channels. In this case, the height of the lamella positioned between the adjacent channels is equal to the height of the remaining lamella of the heat exchanger. In practice, first, the thermal insulator protection layer is applied to a channel or both channels and then, for completing the heat exchanger the lamella is inserted between the channels and fixed there. In case only one channel should be established to have the insulator protection layer according to the invention, the lamella is only used to dissipate the heat of the opposite channel.

In a sixth preferred embodiment of the invention, for thermal decoupling of the adjacent channels, each with a different fluid temperature, for the adjacent flows, one of said channels is established as a blind channel, or an additional blind channel is inserted into the heat exchanger between both fluid-carrying channels. In the simplest case, the blind channel can be an originally provided fluid-carrying channel of a flow, which on the front side—that is in the area of the fluid collector or the fluid distributor, respectively, and/or the deflecting pocket—is tightly closed for the fluid. The channel may be closed using a dash plate or blind plate, respectively, provided separately for the distributor and the collector of the heat exchanger so that no fluid can flow in this channel. In addition, instead of this channel also at least one dash or blind plate, respectively, is positioned at the fluid distributor or the fluid collector. Another method to switch a channel so that the fluid cannot function is to fix this channel for static reasons on both front sides to the distributor or the collector, respectively, and the deflecting pocket, but not to hydraulically couple this channel at these places to the distributor, the collector or the deflecting pocket. In practice, this channel is not brazed to the distributor or the collector, respectively.

Figure 2:
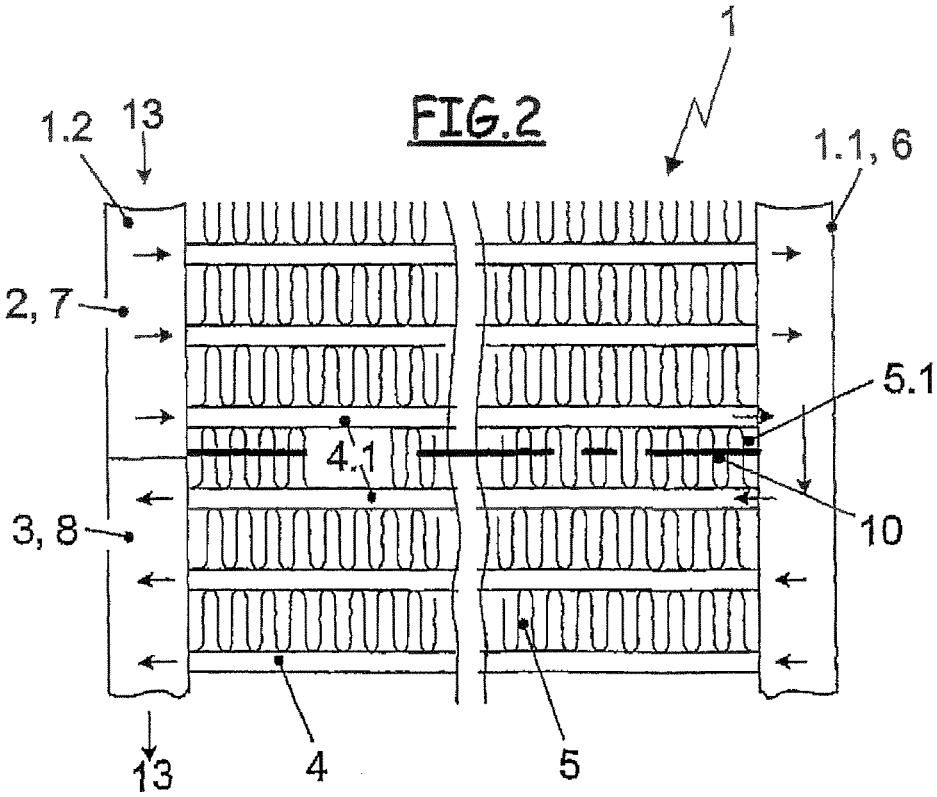
Figure 3:
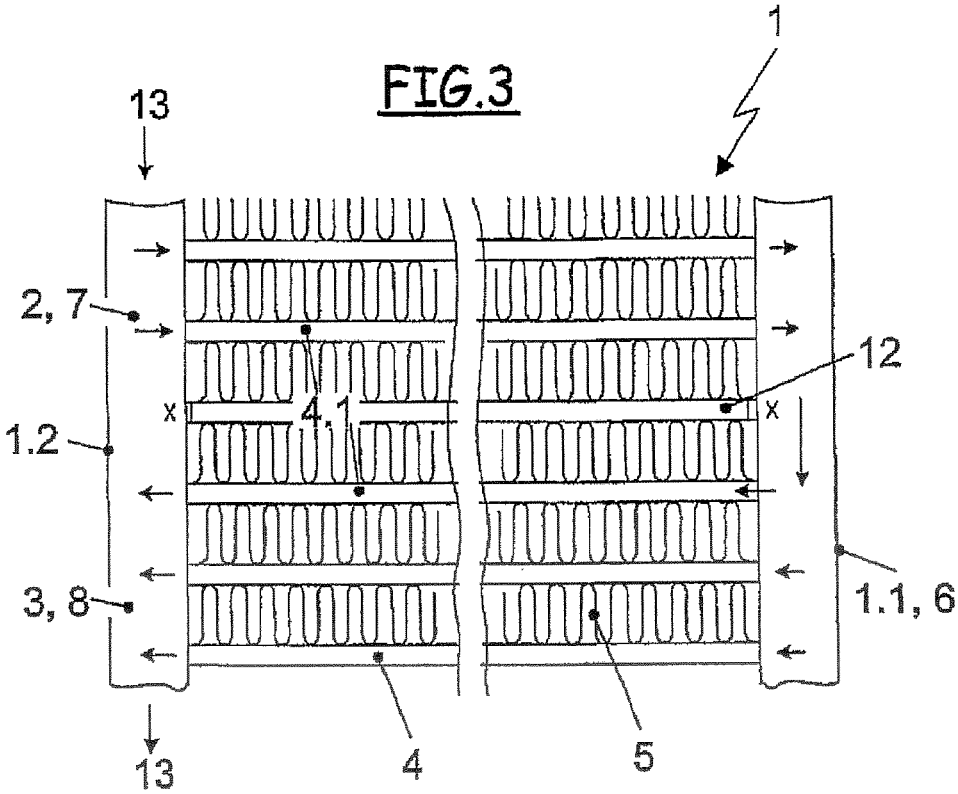
Figure 4:
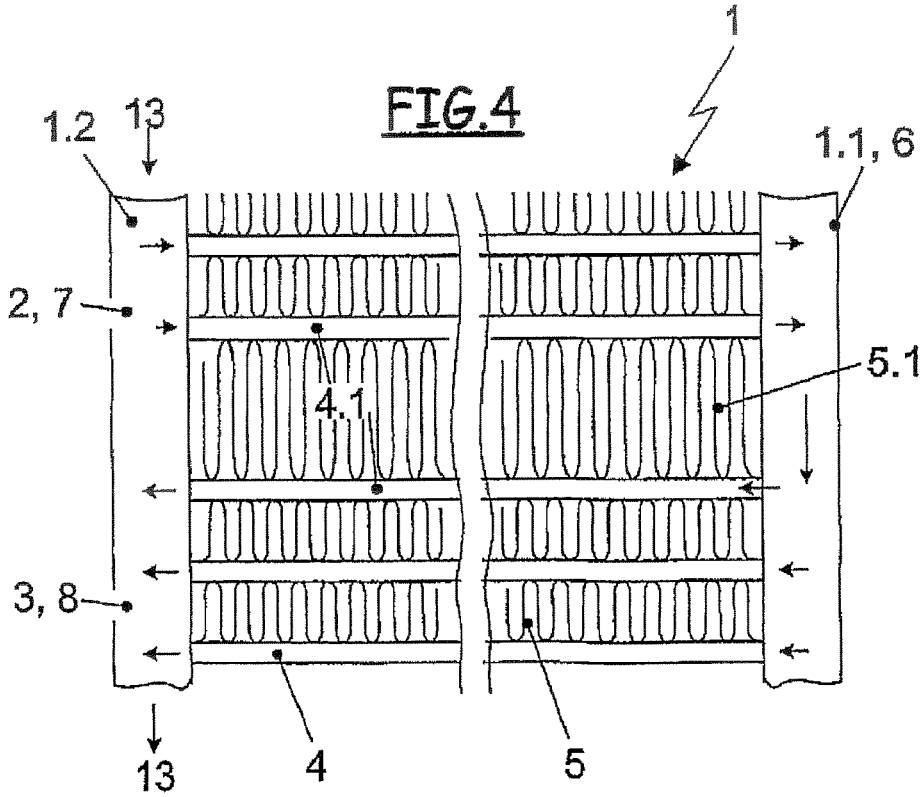
Figure 5:
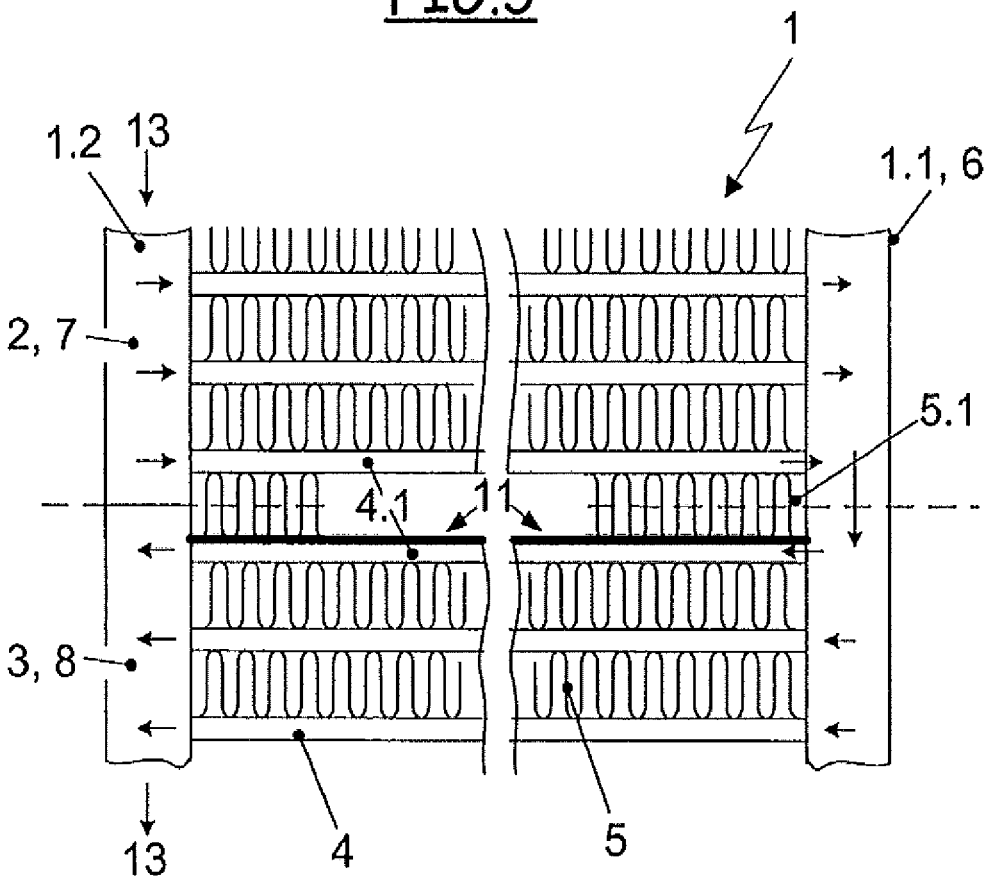
Figure 6:
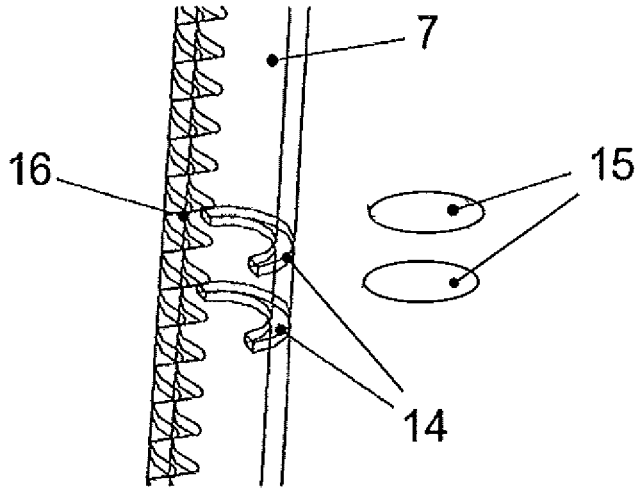
Figure 7:
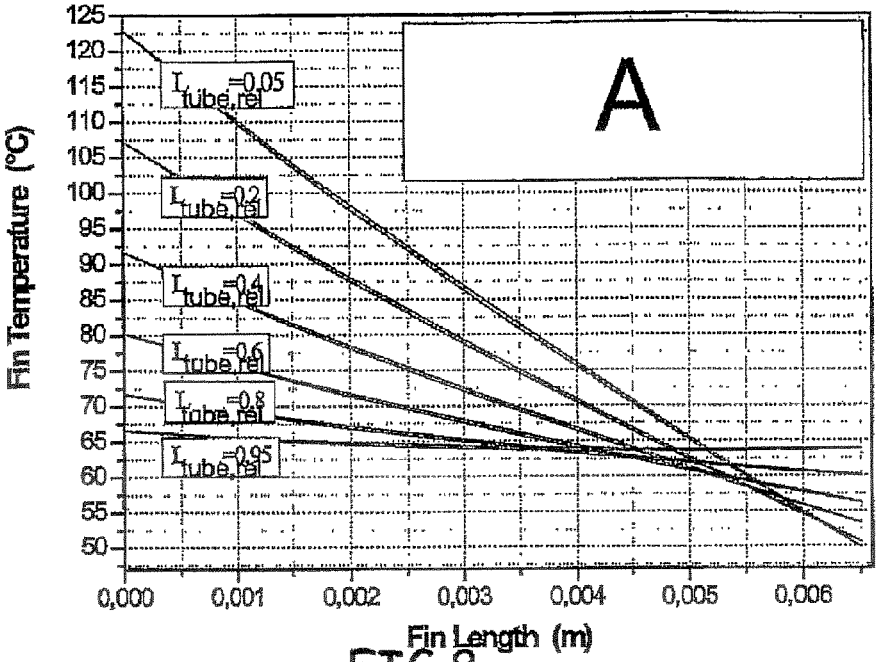
Figure 8:
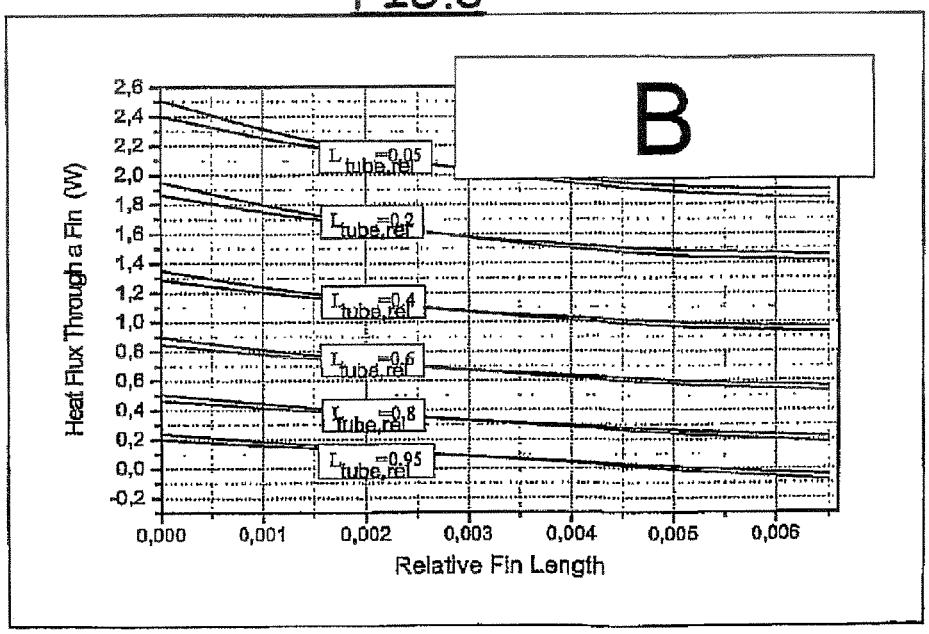
Figure 9:
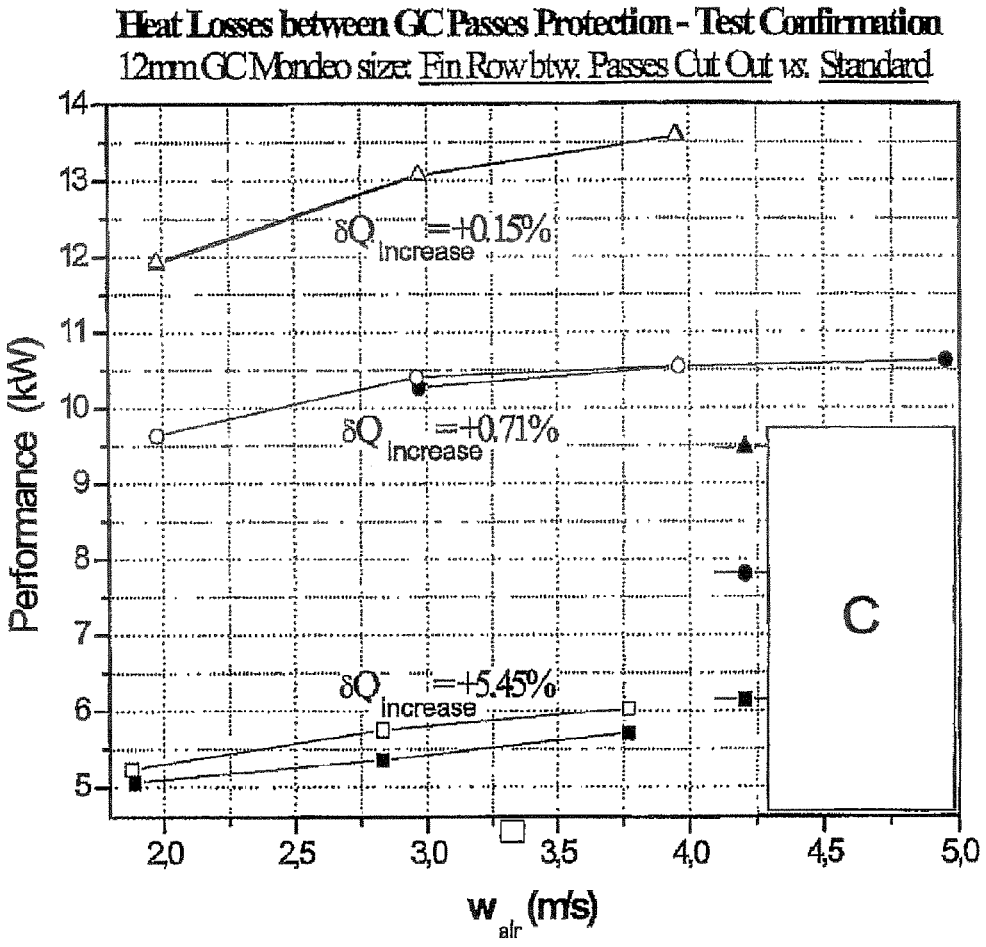

Further details and advantages of the present invention will become apparent to the expert from consideration of the following description of preferred embodiments when taken in connection with the accompanying drawings in which is shown:

FIG. 1 multiple-flow heat exchanger provided with thermal insulator,

FIG. 2 multiple-flow heat exchanger provided with slotted lamella,

FIG. 3 multiple-flow heat exchanger provided with blind channel,

FIG. 4 multiple-flow heat exchanger provided with lamella the structural height of that is changed, FIG. 5 multiple-flow heat exchanger provided with thermal insulator protection layer, FIG. 6 detailed representation of the fluid distributor 7 provided with dash or blind plates, respectively, FIG. 7 diagram of the surface temperature of the lamella positioned between both adjacent channels, FIG. 8 diagram of the heat flow passing through the lamella positioned between both adjacent channels, FIG. 9 diagram of the total heating power of a heat exchanger with and without thermal decoupling of both adjacent channels.

FIGS. 1 to 6 show a cross-sectional view of the multiple-flow heat exchanger 1 according to the invention, representing the different design solutions for the thermal decoupling of the adjacent channels 4.1, each with a different fluid temperature, for the adjacent flows 2, 3. The heat exchanger 1 established as gas cooler essentially comprises two flows 2, 3 through which a $CO_2$-refrigerant fluid 13 runs in opposite directions and which each are formed of a group of several parallel channels 4 with lamellae 5 positioned between the channels 4 in a sandwich-type manner. A deflecting pocket 6 is positioned on a first front side 1.1 of the heat exchanger 1, for reversing the direction of the refrigerant fluid 13. A fluid distributor 7 for the first flow 2 and a fluid collector 8 for the second flow 3 are arranged on a second opposing front side 1.2 of the heat exchange 1. Both flows 2, 3, passed by one and the same $CO_2$-refrigerant fluid 13, thus extend between both front sides 1.1, 1.2 of the heat exchanger 1, while the air contributing to heat transmission as second fluid flows vertically to the direction of flow of the $CO_2$-refrigerant fluid 13 through the lamellae 5 of the heat exchanger 1. The entirety of all channels 4 with the lamellae 5 positioned between the channels 4 constitutes a channel-lamella block. The lamellae 5, in the area of their lamella bends, are connected by brazing to both channels 4, framing the lamellae on both sides, in a statically fixed and heat conducting manner. In the example shown, the heat exchanger 1 is established only a one-row channel-lamella block. A heat exchanger 1 switched in a multiple-row manner to the accompanying tubes, however, is not contradictory to the idea of the invention. The central idea of the invention is that the adjacent channels 4.1, each with a different fluid temperature, for the adjacent flows 2, 3 are thermally decoupled from each other.

In FIG. 1, the thermal decoupling of the adjacent channels 4.1, each with a different fluid temperature, for the adjacent flows 2, 3 of the heat exchanger 1 is realized by a thermal insulator. The thermal insulator 9, made of a poor heat conductor with high thermal resistance, is positioned between the adjacent channels 4.1, replacing the original lamella 5. Preferably, as thermal insulator 9 a heat-resistant plastic material is used. The distance of the channels, or the width of the thermal insulator 9, can deviate from the height of the remaining lamella 5, especially be dimensioned smaller. In the simplest case, the thermal insulator 9 consists of "dead air" so that the structural space between the adjacent channels 4.1, each with a different fluid temperature, for the adjacent flows 2, 3 is established free from lamella.

FIG. 2 illustrates a multiple-flow heat exchanger 1 with a slotted lamella 5.1, positioned between the adjacent channels 4.1 for the adjacent flows 2, 3. The slotted lamella 5.1 can be manufactured by a suitable sawing process carried out afterwards. In the example shown, the partially interrupted slot 10 extends parallel to the channels 4 of the heat exchanger 1. It has been found that the slot 10 need not be established absolutely over the total length of the lamella, but above all at those places where the heat losses caused by the great temperature difference are a maximum, that is in the area of the fluid collector 8 and the fluid distributor 7. Due to the slot 10, there are two opposing lamella halves separated by an air gap, the slot 10 hence preventing conductive heat transmission between the adjacent channels 4.1.

In FIG. 3 a multiple-flow heat exchanger 1 is shown provided with a blind channel 12 established between the adjacent channels 4.1, each with a different fluid temperature, for the adjacent flows 2, 3. For a blind channel 12 to form one of both channels 4.1 is closed on its front side tightly for the refrigerant fluid 13, that is in the area of the fluid collector 8 or the fluid distributor 7, respectively, and/or of the deflecting pocket 6. A cross indicates the closure in each came. In practice, a dash plate, or blind plate 15, respectively, mounted on the front side is used in each case so that the respective blind channel 12 is no longer involved in the actual heat transmission.

A lamella 5.1 having a great structural height, positioned between the adjacent channels 4.1, each with a different fluid temperature, for the adjacent flows 2, 3 is shown in FIG. 4. The lamella 5.1 has an enlarged structural height compared with the remaining lamellae 5. The enlarged lamella height, on the one hand, raises the heat transmission distance between the differently tempered adjacent channels 4.1 and, on the other hand, increases the heat transmission surface required for heat transmission from the refrigerant fluid 13 to the air. The lamella height is dimensioned allowing for the difference of the air-side pressure drop due to the lamella 5.1. Additionally, this lamella 5.1, changed in its structural height, can also have a changed, e.g. smaller, material thickness. Both measures according to FIG. 4 aim at reducing the heat losses.

FIG. 5 shows a multiple-flow heat exchanger 1 with a lamella 5.1 positioned between the adjacent channels 4.1, each with a different fluid temperature, for the adjacent flows 2, 3, the lamella provided with a thermal insulator protection layer 11. The thermal insulator protection layer 11 is applied to one of both adjacent channels 4.1 and points toward the lamella 5.1. Here, the height of the lamella 5.1 positioned between the adjacent channels 4.1 is equal to the height of the remaining lamellae of the heat exchanger 1. Typically, first, the thermal insulator protection layer 11 is applied to the channel 4.1 and then, for completing the heat exchanger the lamella 5.1 is inserted between the channels 4.1 and fixed there. In case only one channel 4.1 should be established with the insulator protection layer 11 according to the invention, the lamella 5.1 is only used to dissipate the heat of the opposite channel 4.1.

FIG. 6 shows a detailed representation of the fluid distributor 7 of the heat exchanger 1 according to the invention following FIG. 3. For thermal decoupling of the adjacent channels 4.1, each with a different fluid temperature, for the adjacent flows 2, 3, according to FIG. 3, one of said channels is established as a blind channel 12. For establishing the blind channel 12 two dash plates, or blind plates 15, respectively, am provided positioned in the fluid distributor 7. Both dash plates, or blind plates 15, respectively, engage positively with complementary slots 16, which are, on the one hand, positioned parallel to each other and, on the other hand, extend orthogonally to the longitudinal direction of the fluid distributor 7. In addition, a socket 14 attached to the fluid distributor 7 is provided for each of these dash plates, or blind plates 15. In the simplest case, only one dash plate, or blind plate 15, respectively, may be provided.

FIG. 7 shows a diagram of the surface temperature of the lamella 5.1 in function of its structural length by reference to the example of several channels 4 having different lengths. When the lamella 5.1 contacts two channels 4.1, each with a different fluid temperature—in case of lamellae 5.1 brazed to the outside of the adjacent channels 4.1—temperature profiles may results as shown in FIG. 6. The temperature on the side of the lamella brazed to the one channel 4.1 reduces along the flow distance of the refrigerant fluid 13, whereas on the opposing lamella side brazed to the second channel 4.1 the channel temperature rises. This is due to the opposing directions of flow of the refrigerant fluid 13 in the channels 4 of the first and second flow 2, 3 while at the same time, the temperature other refrigerant fluid 13 goes down.

The heat flow through the lamella 5.1 calculated for these cases is shown in FIG. 8 in form of a diagram. It is obvious that heat (in addition to the heat dissipated to the ambient air by convection) also flows through the lamella 5.1 from one channel 4.1 (lamella length=0) to the other (lamella length=1). Basically, this is the heat loss because the heat transmission distance is shortened. Logically, a considerable amount of heat remains in the refrigerant fluid 13 instead of being dissipated to the air. The heat loss is the higher, the higher the temperature difference between the opposing lamella ends is. The total heat loss for the gas cooler of the investigated size under the limiting conditions (gas cooler depth=12.3 mm; number of refrigerant tubes=45; number of lamella rows=46; lamella height=6.5 mm; lamella pitch=1.13 mm (534 lamellae per tube); Trefin=130° C.; reference mass flow rate=100-200 kg/h; Tair,in=44.8° C.; air mass flow rate=25-70 kg/min) has been calculated for low refrigerant mass flow rates of up to 450 W.

A practical experiment established a similar result. FIG. 9 shows the total performance of a standard 2-channel/12 mm-gas cooler (45 MP-tubes 12×1.2 $mm^2$ and 12×6.5 $mm^2$) without any protection form heat losses between the channels 4.1 (lines with filled markings) and of the same heat exchanger 1 ater removal of the lamellae 5.1 between the channels 4.1, that is with thermal decoupling, (lines with not-filled markings) in form of a diagram. The total heat performance of the gas cooler tested was improved for the set of limiting conditions "Low performance" by 5.45% on average. For higher refrigerant flow rates and higher inlet temperatures of the refrigerant fluid 13 and the air, improvement of the total performance due to the protection from heat losses between the refrigerant channels 4.1 is considerably less. Definitely, under all limiting conditions, the removal of the complete lamella 5.1 between the adjacent channels 4.1, each with a different fluid temperature, for the adjacent flows 2, 3 never caused the performance to decrease.

NOMENCLATURE 1 heat exchanger
1.1 first front side
1.2 second front side
2 first flow
3 second flow
4 channel
4.1 adjacent channels
5 lamella
5.1 lamella
6 deflecting pocket

7 fluid distributor
8 fluid collector
9 thermal insulator
10 slot
11 thermal insulator protection layer
12 blind channel
13 fluid, refrigerant fluid
14 socket
15 dash plate or blind plate, respectively
16 slot

The invention claimed is:

1. A multiple-flow heat exchanger, comprising:

a first flow passable by a fluid in a first direction, the first flow including a plurality of parallel first channels;

a second flow passable by the fluid in a second opposite direction, the second flow including a plurality of parallel second channels;

a deflecting pocket disposed on a first side of the heat exchanger in fluid communication with the first flow and the second flow, wherein the deflecting pocket is configured to manipulate a direction of the fluid from the first direction to the second direction;

a fluid distributor disposed on an opposing second side of the heat exchanger in fluid communication with the first flow;

a fluid collector disposed on the second side of the heat exchanger in fluid communication with the second flow;

a blind channel substantially impassable by the fluid, wherein the blind channel is disposed between an adjacent one of the first channels of the first flow and an adjacent one of the second channels of the second flow to thermally decouple the first flow from the second flow, and wherein the adjacent one of the first channels of the first flow has a different fluid temperature than the adjacent one of the second channels of the second flow, and wherein the blind channel is established by at least one plate extending orthogonally to a longitudinal direction of the fluid distributor; and at least one lamella disposed between at least one of adjacent first channels of the first flow and adjacent second channels of the second flow.

2. The multiple-flow heat exchanger according to claim 1, wherein the heat exchanger includes at least one of a condenser, a radiator and an evaporator.

3. The multiple-flow heat exchanger according to claim 1, wherein the fluid is a $CO_2$-refrigerant.

4. A multiple-flow heat exchanger, comprising:

a first flow passable by a fluid in a first direction, the first flow including a plurality of parallel first channels;

a second flow passable by the fluid in a second opposite direction, the second flow including a plurality of parallel second channels;

a deflecting pocket disposed on a first side of the heat exchanger in fluid communication with the first flow and the second flow, wherein the deflecting pocket is configured to manipulate a direction of the fluid from the first direction to the second direction;

a fluid distributor disposed on an opposing second side of the heat exchanger in fluid communication with the first flow;

a fluid collector disposed on the second side of the heat exchanger in fluid communication with the second flow;

a blind channel substantially impassable by the fluid, wherein the blind channel is disposed between an adjacent one of the first channels of the first flow and an adjacent one of the second channels of the second flow to thermally decouple the first flow from the second flow, and wherein the adjacent one of the first channels of the first flow has a different fluid temperature than the adjacent one of the second channels of the second flow, and wherein the blind channel is established by at least one plate disposed in the fluid distributor, and wherein the at least one plate extends orthogonally to a longitudinal direction of the fluid distributor, and at least one lamella disposed between adjacent first channels of the first flow, between adjacent second channels of the second flow, between the blind channel and the adjacent one of the first channels of the first flow, and between the blind channel and the adjacent one of the second channels of the second flow.

5. The multiple-flow heat exchanger according to claim 4, wherein the heat exchanger includes at least one of a condenser, a radiator and an evaporator.

6. The multiple-flow heat exchanger according to claim 4, wherein the fluid is a $CO_2$-refrigerant.

7. A multiple-flow heat exchanger, comprising:

a first flow passable by a fluid in a first direction, the first flow including a plurality of parallel first channels, wherein at least one lamella is disposed between each of the first channels of the first flow;

a second flow passable by the fluid in a second opposite direction, the second flow including a plurality of parallel second channels, wherein at least one lamella is disposed between each of the second channels of the second flow, and wherein a temperature of the fluid in the first flow is different from a temperature of the fluid in the second flow;

a deflecting pocket disposed on a first side of the heat exchanger in fluid communication with the first flow and the second flow, wherein the deflecting pocket is configured to manipulate a direction of the fluid from the first direction to the second direction;

a fluid distributor disposed on an opposing second side of the heat exchanger in fluid communication with the first flow, the fluid distributor provided with a socket;

a fluid collector disposed on the second side of the heat exchanger in fluid communication with the second flow; and a blind channel substantially impassable by the fluid, wherein the blind channel is disposed between the first flow and the second flow to thermally decouple the first flow from the second flow, and wherein at least one lamella is disposed between the blind channel and at least one of the first flow and the second flow, wherein the blind channel is established by at least one plate received in the socket of the fluid distributor, the at least one plate extending orthogonally to a longitudinal direction of the fluid distributor.

8. The multiple-flow heat exchanger according to claim 7, wherein the heat exchanger includes at least one of a condenser, a radiator and an evaporator.

9. The multiple-flow heat exchanger according to claim 7, wherein the fluid is a $CO_2$-refrigerant.

10. The multiple-flow heat exchanger according to claim 1, wherein the at least one plate closes an open end of the blind channel.

11. The multiple-flow heat exchanger according to claim 1, wherein the at least one plate engages a corresponding slot formed in the fluid distributor.

12. The multiple-flow heat exchanger according to claim 1, wherein the at least one plate is received in a socket of the fluid distributor.

13. The multiple-flow heat exchanger according to claim 4, wherein the at least one plate engages a corresponding slot formed in the fluid distributor.

14. The multiple-flow heat exchanger according to claim 4, wherein the at least one plate is received in a socket of the fluid distributor.

15. The multiple-flow heat exchanger according to claim 7, wherein the at least one plate engages a corresponding slot formed in the fluid distributor.

* * * * *